United States Patent [19]

Crouch

[11] 4,048,688

[45] Sept. 20, 1977

[54] CONTROL MECHANISM FOR EDGE FOLDING MACHINES

[75] Inventor: Ivan Percy Crouch, Leicester, England

[73] Assignee: USM Corporation, Boston, Mass.

[21] Appl. No.: 729,011

[22] Filed: Oct. 4, 1976

[30] Foreign Application Priority Data

Oct. 4, 1975 United Kingdom ..... 40698/75

[51] Int. Cl.[2] ..... A43D 11/00; B05C 3/02

[52] U.S. Cl. ..... 12/55.1; 118/410

[58] Field of Search ..... 12/55.1, 55, 24.5; 118/410; 156/538, 539, 543

[56] References Cited

U.S. PATENT DOCUMENTS

| | | | |
|---|---|---|---|
| 2,720,667 | 10/1955 | Naugler | 12/55.1 |
| 3,121,242 | 2/1964 | Longval | 12/55.1 |
| 3,530,521 | 9/1970 | Bocca et al. | 12/55.1 |

*Primary Examiner*—Patrick D. Lawson

*Attorney, Agent, or Firm*—Carl E. Johnson; Richard B. Megley; Vincent A. White

[57] ABSTRACT

An edge folding machine having edge snipping means, and means for adjustably determining maximum and minimum feed length settings for workpieces having different edge configurations, is also provided with mechanism whereby an operator can adjust the amount or spacing of margin splitting by the snipping means as considered appropriate for "inside", i.e. concave edge portions of the work.

4 Claims, 2 Drawing Figures

CONTROL MECHANISM FOR EDGE FOLDING MACHINES

BACKGROUND OF THE INVENTION

This invention is concerned with improvements in or relating to folding machines, more especially edge folding machines for progressively folding over a marginal portion of a workpiece, e.g. a shoe upper.

The phrase "an edge folding machine of the type herein defined" where used herein is to be understood as referring to "an edge folding machine for progressively folding over a marginal portion of a workpiece, comprising folding instrumentalities arranged at an operating locality of the machine, workpiece feeding means for feeding a workpiece step-by-step- through the operating locality, control means whereby the feed length of each feed movement of the workpiece feeding means can be varied during the operation of said workpiece feeding means, a reciprocatory slitting mechanism, operable in timed relation with the operation of the workpiece feeding means, for slitting the marginal portion of a workpiece as it is fed to the operating locality of the machine by the workpiece feeding means, and actuating means for causing the slitting mechanism to operate".

In using such a machine, conventionally when operating on an "outside" (i.e., convex) curve along the periphery of a workpiece, the feed length referred to above is shortened, thus to facilitate pleating of the material of the folded-over portion. It will of course be appreciated that, where such a curve arises, there is excess material in the folded-over portion in comparison with the surface of the workpiece to which the folded-over portion is to be secured. Conversely when operating on an "inside" (i.e., concave) curve, where the amount of material in the folded-over portion is less than the material of the surface to which it is to be secured, the slitting mechanism is caused to provide a series of slits in the portion to be folded over, prior to such folding, thus to facilitate its subsequent securing without distortion. Slitting is usually effected with the feed length selected at a maximum in order to avoid the provision of a larger number of closely spaced slits (the slitting arrangement making one slit for each feed movement of the workpiece feeding means).

In order to accommodate the different feed length requirements, the control means of edge folding machines of the type herein defined conventionally comprises adjustable means whereby a maximum setting and a minimum setting can be made for the feed length.

Furthermore, it has usually been the case that the adjustable setting means is biased towards the maximum feed setting, although it has been proposed to bias the adjustable means towards the minimum feed setting. Thus, for example, in one machine of the type herein defined, operator-controlled means in the form of a treadle has been provided to facilitate altering the setting of the feed length under the control of the operator according to the edge contour of the workpiece being operated upon, and also to cause the slitting arrangement to operate as required by said contour, the treadle being so arranged that the maximum feed length is selected whenever the slitting arrangement is caused thus to operate.

Again, by way of further example, in another machine of the type herein defined, the feed length is automatically controlled according to the edge contour of the workpiece being operated upon, said contour being sensed e.g. by photo-electric sensing means. In this machine the minimium feed length setting is selected only when an outside curve is sensed, the maximum setting being otherwise used (including any operation involving the operation of the slitting arrangement).

It will thus be appreciated that if the maximum feed setting is to be used during the slitting arrangement, such maximum setting has to be determined according to what feed setting can be tolerated by the curvature of the "inside" curves. A substantial part of the periphery of a workpiece may, however, be relatively straight and thus capable of being folded over using a higher feed length setting than the maximum in fact set because of the "inside" curves, so that in a working day operating time may be lost.

It is one of the various objects of the present invention to overcome this disadvantage in existing machines of the type herein defined. To this end, the invention provides, as one of its several features, an edge folding machine of the type above defined wherein the control means comprises first adjusting or setting means whereby a maximum setting and a minimum setting can be made for the feed length of each feed movement of the workpiece feeding means, and second setting means whereby a further setting can be made for said feed length, the machine also comprising further actuating means which operates when the first-mentioned actuating means is operated, and thus when being effective to ensure that the operation of said further actuating means being effective to ensure that the setting of the feed length, while the slitting arrangement is operating, is not less than said further setting therefor made by means of the second setting means.

It will thus be appreciated that by providing a further setting independently of the maximum setting of the feed length, an optimum maximum feed length can be achieved for straight line operating. Furthermore, by providing an adjustment facility by which the further setting can be made for slitting purposes, an optimum "slitting" feed length can be also be achieved.

The further setting which is thus made provides merely a "minimum slitting" feed length setting. If the feed length setting in use during an operation is greater than such "minimum slitting" setting, then operation of the further actuating means will be of no effect.

A machine in accordance with the invention may be arranged so that the feed length setting is biased towards a maximum, but preferably a bias is provided, e.g. by spring means, towards a minimum setting as herein disclosed. In this way to achieve a "minimum slitting" feed length setting when the slitting arrangement is caused to operate, where the setting would otherwise be less than said "minimum slitting" setting, the further actuating means is arranged to act against the influence of such biasing means.

The further actuating means, which preferably comprises a solenoid, is conveniently arranged to act, directly or indirectly, on a lever forming part of the control means, the arrangement being such that the further actuating means is not secured to said lever but rather relies on abutting engagement so that, when the slitting arrangement is inoperative, the position of the lever, and thus the feed length setting, can be determined without the further actuating means being affected.

Furthermore, the "minimum slitting" setting can be varied, as appropriate to the workpiece to be operated upon, by varying the positional relationship between the further actuating means and the surface which is abuttingly engaged. This variation may be achieved in accordance with the invention by moving the further actuating means relative to such surface, but preferably the surface is provided by a linkage arrangement comprising a link capable of lengthwise, e.g. telescoping, adjustment, the link being pivotally connected to the lever of the control means. Where such a link is provided, adjustment is conveniently facilitated by the link comprising two portions, one threadedly received within the other, so that relative rotation is effective to shorten or lengthen the overall length of the link.

The first setting means of the machine preferably comprises a further lever fixedly connected to the first-mentioned lever, the two levers being mounted for pivotal movement on a shaft of the control means, rotation of which shaft is effective to vary the feed length setting of the workpiece feeding means. For providing maximum and minimum settings, the first setting means conveniently comprises adjustable stop means for the further lever, either in the form of conventional adjustable stop screws, or a series of apertures into which selectively stop pins may be inserted so as to extend into the path of movement of the further lever, or a combination of a series of apertures into which one pin may be so inserted, e.g. for the maximum setting, with an adjustable stop screw, e.g. for the minimum setting.

In using such a machine, the operator conveniently makes the maximum and minimum feed length settings, according to the edge contour of the workpiece to be operated upon, using the first setting means, and also makes the further setting, using the second setting means, according to the amount of slitting deemed appropriate for the "inside" curves of such workpiece.

It will be appreciated that the invention as set out above is applicable to both operator-controlled machines and also automatically controlled machines.

BRIEF DESCRIPTION OF THE DRAWINGS

The above and other of the various objects and several features of the invention will become clearer from the following detailed description, to be read with reference to the accompanying drawings, of a machine embodying the invention (hereinafer called "the illustrative machine"). It will of course be appreciated that this illustrative machine has been selected for description by way of exemplification of the invention and not by way of limitation thereof.

DESCRIPTION OF THE PREFERRED EMBODIMENT

Figure 1:
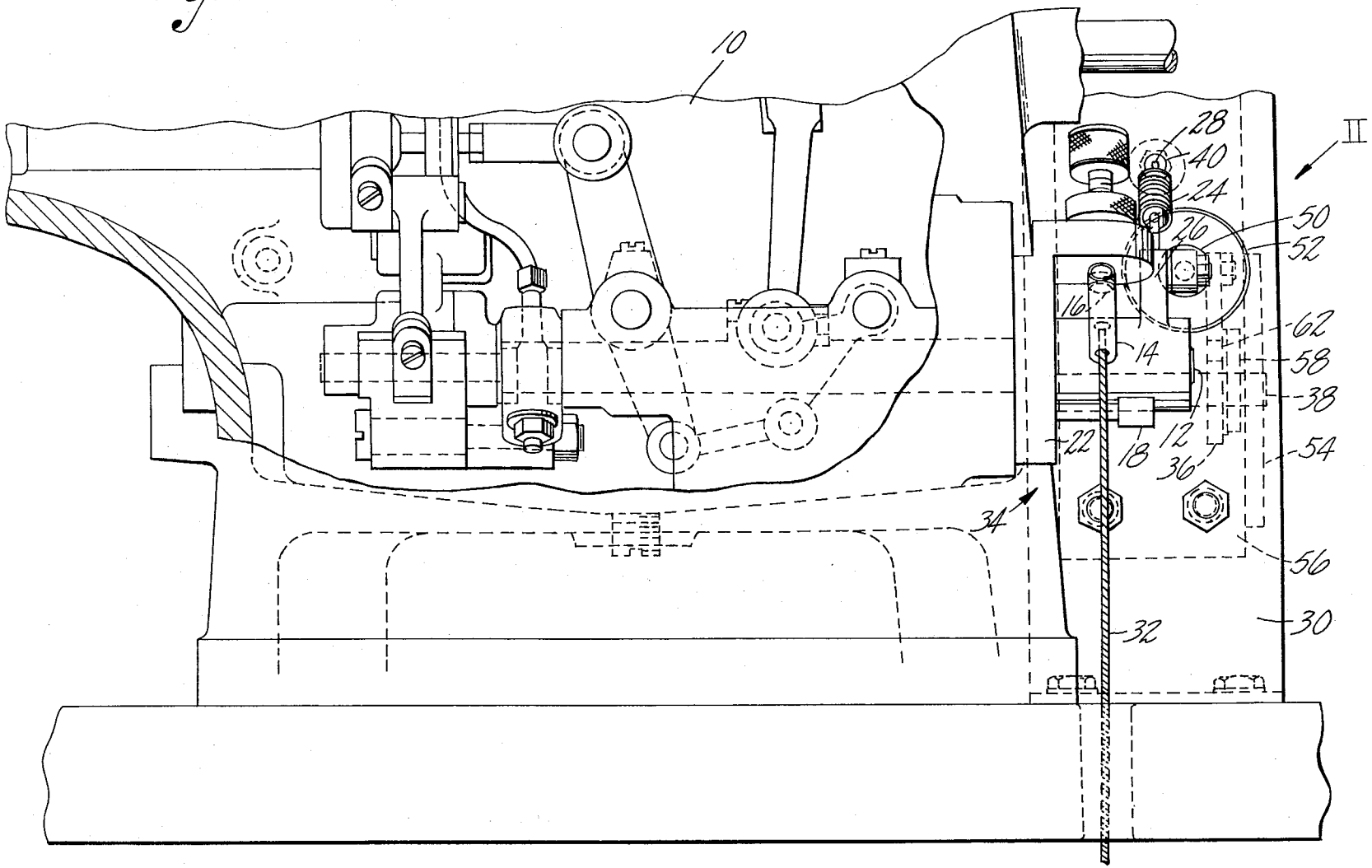
FIG. 1 is a view is side elevation of a cementing and folding machine, with frame portions broken away to show internal mechanism.

In the accompanying drawings is shown a fragmentary view of the illustrative machine, showing parts, including first and second adjustable setting means, of the control means thereof together with further actuating means associated with said second setting means.

The illustrative machine, which is generally similar, except as hereinafter described, to the edge folding machine described in U.S. Letters Patent No. 2,720,667 in the name of R. E. Nangler, is a machine of the type herein-above defined and comprises folding instrumentalities (not shown), including a so-called gage block, gage finger, folding finger and creaser foot (corresponding to the elements 24, 28, 30 and 32 respectively of the machine described in said Patent). The folding instrumentalities are supported in a machine frame in the form of a casting, a portion 10 of which is shown in the drawing. As is conventional, the creaser foot of the illustrative machine has a passage through which hot melt adhesive can be supplied, thus to feed adhesive into the area of fold of the marginal portion of a workpiece prior to its being folded over in the operation of the machine.

The illustrative machine also comprises workpiece feeding means (not shown) constituted by a hammer and anvil (corresponding to the hammer and anvil 36, 38 of the machine described in the aforementioned Patent, which also act together to grip and press a fold after it has been formed in a workpiece margin. It will be appreciated that the hammer and anvil are effective to feed a workpiece step-by-step through the operating locality of the illustrative machine.

In addition, the illustrative machine comprises a reciprocatory slitting arrangement constituted by a slitting knife and actuating means therefor (not shown, but corresponding respectively to the snipping knife 40 of the machine described in the aforementioned Patent and the actuating means therefor), said arrangement being operable in timed relationship with the workpiece feeding means of the illustrative machine and being effective, when caused to operate by operation of the actuating means, to slit the marginal portion of a workpiece as it is fed therepast to the operating locality, the arrangement being such that the knife operates once for each feed movement of the workpiece feeding means.

Figure 2:
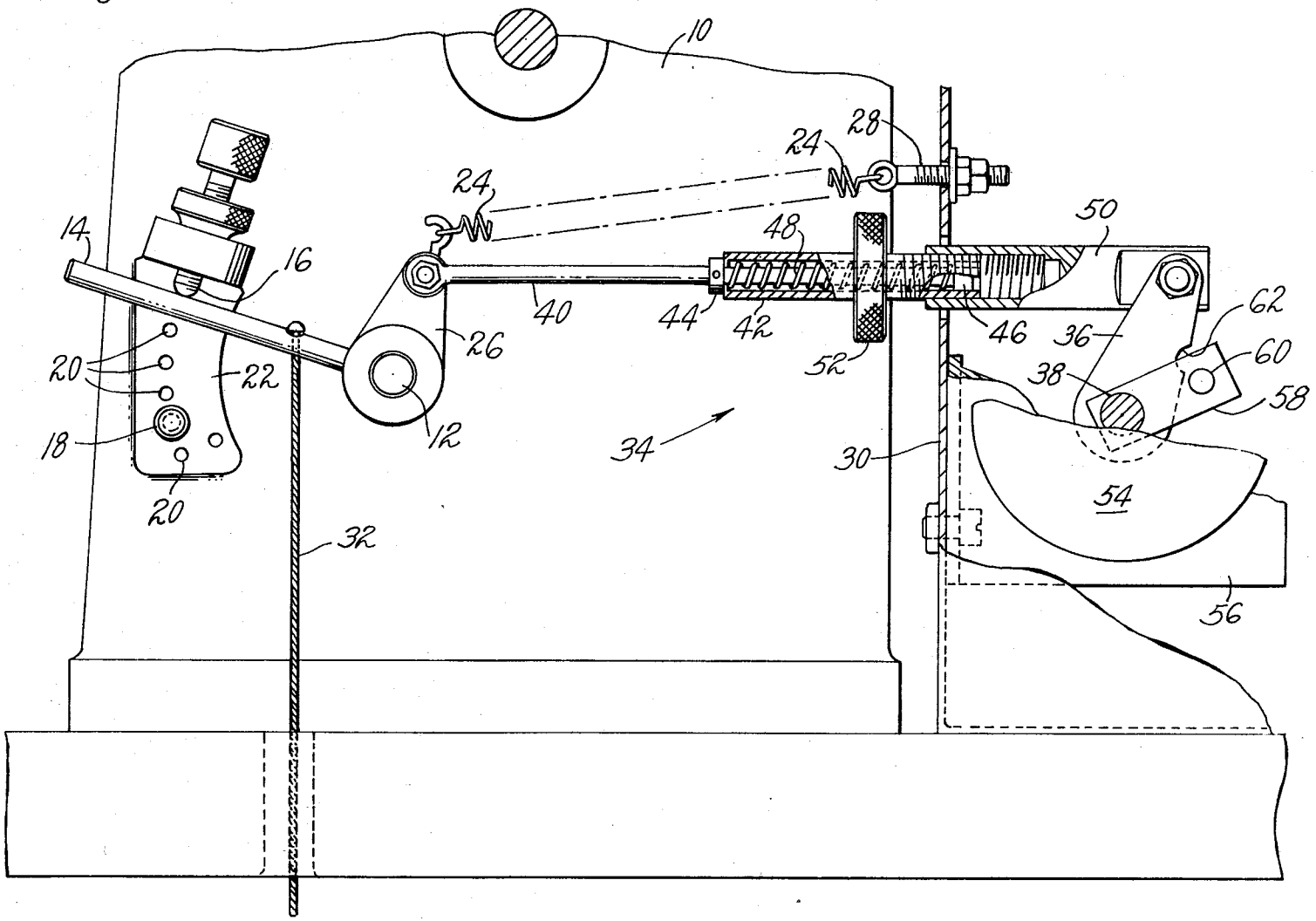
FIG. 2 is a view looking in the direction of the arrow II in FIG. 1 and showing portions of the work feed and snipper feed control means.

The illustrative machine further comprises control means whereby the feed length of each feed movement of the workpiece feeding means can be varied, said control means comprising a so-called feed control shaft 12 (FIGS. 1, 2) (corresponding to the shaft 174 of the machine described in the aforementioned Patent) which is supported for rotation in the frame portion 10. Secured to the shaft 12 is a lever 14 extending towards the front of the machine and thus mounted for pivotal movement with said shaft between a first position, determined by an adjustable stop screw 16 supported on the machine frame, and a second position, selectively determined by a stop pin 18 (FIGS. 1, 2) inserted in a selected one of a series of apertures 20 formed in a surface 22 of the frame portion 10, the pin 18 being arranged to extend into the path of the lever 14.

The lever 14, stop screw 16 and pin 18 together with its associated apertures constitutes first adjustable setting means of the control means of the illustrative machine, the first and second, adjusted, positions of the lever serving to determine respectively minimum and maximum settings for the feed length of each feed movement of the workpiece feeding means.

The lever 14 is biased towards the minimum setting by means of a spring 24 acting between a lever 26, also secured on the shaft 12, and an eye 28 adjustably mounted in a wall of a housing 30 carried at the rear of the frame portion 10. In operation, the lever 14 is moved out of its first position, under the control of the operator, by actuation of a treadle (not shown) operatively connected to the lever by a Bowden cable 32. The treadle also serves to enable the operator to vary the speed at which the folding instrumentalities, workpiece feeding means and slitting arrangement are operated, the arrangement being such that the further the treadle is depressed, the higher the speed of operation as well as the larger the feed length setting.

Acting on the lever 26 is second setting means of the illustrative machine, by which means a further setting of the feed length is made by the operator, said means comprising a linkage arrangement including a link generally designated 34 capable of lengthwise telescoping adjustment. The link 34 is pivotally connected at one end to the lever 26 and at its other end to another lever 36, which is mounted for pivotal movement on a shaft 38, referred to hereinafter. The link 34 comprises a first rod portion 40 pivotally connected to the lever 26, the end of said portion remote from the lever being accommodated within a second sleeve portion 42. The sleeve portion is capable of sliding movement on the rod portion to a limit determined by two collars 44, 46, and a spring 48 serving to urge the sleeve in a direction away from the lever 26. An end portion, remote from the lever 26, of the sleeve portion is threadedly received in a threaded bore of a third rod portion 50 of the link 34, which is pivotally connected with the lever 36. The sleeve portion 42 can be rotated relative to the rod portion 50 thus to obtain relative lengthwise movement therebetween and thus to vary the overall length of the composite link. To assist in effecting such rotation, a knurled head 52 is provided on the sleeve portion.

The illustrative machine also comprises further actuating means associated with the second setting means and comprising a rotary solenoid 54 mounted on a bracket 56 within the housing 30, the solenoid having an output shaft constituted by the shaft 38. Thus, upon energization of the solenoid, the shaft 38 is caused to rotate through a fixed distance, being part of one revolution. Fixedly mounted on the shaft 38 is a carrier arm 58 supporting an abutment pin 60 by means of which the lever 36 can be abuttingly engaged, a recess 62 for accommodating the pin being provided in said lever.

The further actuating means of the illustrative machine is operated when the first-mentioned actuating means is operated, and thus when the slitting arrangement is caused to operate. Operation of the further actuating means is effective to ensure that the setting of the feed length, while the slitting arrangement is operations, is not less than the further setting therefor, which is made by means of the adjustable link of the second setting means. Thus, if, at the time of operating the first-mentioned actuating means, the feed length setting, as determined under the control of the operator, is less than said further setting, as determined by the second setting means, operation of the further actuating means will be effective to cause the pin 60 abuttingly to engage the lever 36 and thus to cause, through the link 34 and lever 26, rotation of the feed control shaft 12, with consequent variation of the feed length setting to said further setting. Where, on the other hand, at the time of operating the actuating means, the feed length setting is greater than said further setting, operation of the further actuating means will be ineffective to alter the setting, since the "stroke" of the pin 60 will be insufficient to bring the pin into abutting engagement with the lever 36.

It will thus be appreciated that, in using the illustrative machine, desired maximum (and minimum) feed length settings can be made, as are considered the optima for the workpiece to be operated upon, independently of the feed length setting desired when the slitting arrangement is in operation, and further the "minimum slitting" feed length setting can be made as is considered an optimum for the workpiece to be operated upon.

Having thus described my invention, what I claim as new and desired to secure by Letters Patent of the United States is:

1. An edge folding machine comprising means for intermittently feeding the margin of a workpiece to and through the operating zone of edge folding instrumentalities, control mechanism for setting a maximum and a minimum feed length by which said means can incrementally move the margin, means for slitting the margin as it is fed, a second mechanism for making a further setting of the feed length, and an actuating means operative during operation of said control mechanism and the slitting means to determine the snipping feed length independently of the settings for maximum and minimum feed lengths.

2. Edge folding machine for progressively folding over a marginal portion of a workpiece, comprising folding instrumentalities movable at an operating locality of the machine, workpiece feeding means for feeding a workpiece step-by-step through the operating locality, a feed control device by which the feed length of each feed movement of the workpiece feeding means can be varied, said device including a feed control shaft which is operatively connected with a workpiece feeding means and rotation of which is effective to cause the feed length to be varied as aforesaid, and setting means for setting maximum and minimum lengths to the rotation of said shaft, and thus to the feed length variation, the machine also comprising a reciprocatory slitting knife mechanism, operable in timed relation with the operation of the workpiece feeding means, for slitting the marginal portion of the workpiece fed by the workpiece feeding means as aforesaid, and an actuator by which the slitting knife mechanism can be brought into operation, characterized by the provision of a lever (26) mounted on the feed control shaft (12), a lever (36) connected to the lever (26) by means of a telescopic link (34), said lever (36) providing a surface (62) engageable by an abutment (60) carried by a fixed-stroke actuator (54, 58), whereby said fixed-stroke actuator (54, 58) is operable when the first-mentioned actuator is operated to bring the slitting knife mechanism into operation, and further wherein the first-mentioned lever (26) is also movable, together with the feed control shaft (12), independently of the fixed-stroke actuator (54, 58).

3. Machine according to claim 2 characterized in that the link (34) comprises a rod portion (40) connected to the lever (26) and having a sleeve portion (42) slidable and rotatably mounted thereon, the sleeve portion (42) being threadedly engageable with a further, hollow, rod portion (50) of the link (34).

4. Machine according to claim 2 characterized in that the fixed-stroke actuator (54, 58) comprises a rotary solenoid (54) having an actuator lever (58) fixedly mounted on its output shaft (38), on which also the lever (36) is freely mounted, the actuator lever (58) carrying an abutment (60) for cooperation with the surface (62) of the further lever (36) as aforesaid.

* * * * *